United States Patent [19]

Kelso

[11] Patent Number: 4,995,204

[45] Date of Patent: Feb. 26, 1991

[54] FOUNDATION LEVELING SHIM AND SYSTEM

[76] Inventor: Kenneth J. Kelso, P.O. Box 37222, Houston, Tex. 77036

[21] Appl. No.: 309,181

[22] Filed: Feb. 13, 1989

[51] Int. Cl.[5] ..... E04B 1/16

[52] U.S. Cl. ..... 52/126.1; 52/126.6; 52/292; 405/230

[58] Field of Search ..... 52/125.1, 126.1, 126.5, 52/126.6, 292, 167; 405/229, 230, 233, 235

[56] References Cited

U.S. PATENT DOCUMENTS

| | | | |
|---|---|---|---|
| 1,049,221 | 12/1912 | Frankignoul | 52/126.5 X |
| 1,447,609 | 3/1923 | Zucco | 405/235 |
| 1,827,921 | 10/1931 | White | 405/230 |
| 2,322,855 | 6/1943 | Lenahan | 405/230 |
| 3,053,015 | 9/1962 | Graham | 52/125.1 X |
| 3,065,573 | 11/1962 | Goldberg | 52/125.1 |
| 3,796,055 | 3/1974 | Mahony | 405/230 |
| 4,011,705 | 3/1977 | Vanderklaauw | 52/125.1 X |
| 4,058,952 | 11/1977 | Donnelly | 52/125.1 X |
| 4,251,974 | 2/1981 | Vanderklaauw | 52/125.1 X |
| 4,507,069 | 3/1985 | Murray et al. | 52/125.1 X |
| 4,591,466 | 5/1986 | Murray et al. | 405/229 X |
| 4,765,777 | 8/1988 | Gregory | 405/229 X |
| 4,800,700 | 1/1989 | May | 52/125.1 X |
| 4,854,782 | 8/1989 | May | 405/230 |

*Primary Examiner*—David A. Scherbel
*Assistant Examiner*—Lan Mai
*Attorney, Agent, or Firm*—Matthews & Associates

[57] ABSTRACT

A hydraulic self contained foundation leveling shim is provided and placed in the upper end of a poured concrete foundation leveling pier before curing. Hydraulic hoses lead to the surface to allow hydraulic fluid to be pumped into and removed from the hydraulic chamber of the shim to raise or lower the foundation on the pier. A plurality of the piers and shims is used to level the foundation of a structure that has settled in unstable soil.

12 Claims, 3 Drawing Sheets

FOUNDATION LEVELING SHIM AND SYSTEM

BACKGROUND OF THE INVENTION

The performance of slab-on-grade foundations can be adversely effected by several factors. The primary cause of foundation distress where a residential building or commercial structure has been constructed on an expansive clay soil is the transfer of moisture across the perimeter grade beam. Such conditions generally occur as the result of low rainfall over long periods of drought, as the result of evaporation through uncovered soil, or from extraction of moisture from the soil through tree or large bush roots.

The failure of a foundation to perform the function for which it is intended is manifested in several ways. Cracks on interior and exterior walls are perhaps the most obvious signs of foundation shifting but these can often be misleading. Other, and perhaps more reliable signs of foundation distress, include separations between brick veneer and window frames, separations at the corners of facia or trim boards, misaligned door frames (doors that will not close, that sometimes open by themselves, or which do not fit squarely in their frames), separations between rafters and ridge beams, and sloping floors.

Whatever the cause or manifestation of the foundation failure, the condition must be corrected or eventually the structure may collapse or have to be condemned. Some of the remedial measures available to compensate for excessive foundation distress include moisture stabilization, foundation underpinning, driven precast piles, moisture barriers and mud pumping.

The use of drilled piers to underpin a foundation is perhaps the most common remedial measure in use today. In this procedure holes approximately eight feet by eight feet by three feet are dug at selected intervals under the foundation grade beam. An eight-inch to thirty-inch shaft is then drilled to a depth of between eight and twenty feet below the surface of the soil to a bearing soil. The bottom of the hole is flared out to give a larger bearing surface. Reinforcing steel is then placed in the hole and the hole is filled with concrete up to within approximately one foot of the foundation grade beam. After the concrete has cured for at least three days, expensive structural jacks are placed beneath the grade beam and the foundation is raised upward. When the desired height of the foundation has been achieved, the jacks are replaced with concrete blocks and steel shims. The number and location of the piers is extremely important. Where only one part of the foundation has deflected, only that portion need be leveled and supported, but there is the risk that later work may be required to level other parts of the foundation.

The underpinning technique has disadvantages including the high cost of the piers, disastrous results if the piers should fail, and the disruption of normal activities during their construction. Additionally, if proper maintenance is not applied, such as moisture maintenance, the foundation may have to be releveled on the piers by rejacking and placement of additional steel shims.

SUMMARY OF THE INVENTION

In short, the invention replaces the jacks, concrete blocks and steel shims of the drilled and poured underpinning technique. When the concrete piers are poured, a self contained leveling shim is placed into the uncured concrete between the piers and the foundation grade beam. After curing, hydraulic fluid is injected into the self contained leveling shim to raise the foundation to the desired height. Alternatively, the shim may be placed onto the cured pier.

Hydraulic fluid inlet and outlet means are provided to the self contained leveling shim in the form of high pressure hoses leading to the surface. The inlet hose includes a one way check valve to prevent the hydraulic fluid from back flowing to the injection device. The outlet hose includes a valve to allow removal of the hydraulic fluid for more control of the leveling process. In lieu of two hoses, only one hose may be used with a single high pressure valve to control flow of the hydraulic fluid.

One major advantage of the self contained leveling shim is that it is inexpensive and may be left in place with the hoses leading to the surface after the excavation has been filled. If at a later time, more leveling is needed, the injection device may be re-connected to the inlet hose and more hydraulic fluid injected to raise the foundation.

BRIEF DESCRIPTION OF THE DRAWING

FIG. 6 is a side elevational view in cross section of a third embodiment of the foundation leveling shim of the present invention.

DESCRIPTION OF THE PREFERRED EMBODIMENT

For a detailed description of the preferred embodiment of the invention the reader is directed to the accompanying drawings.

Figure 1:
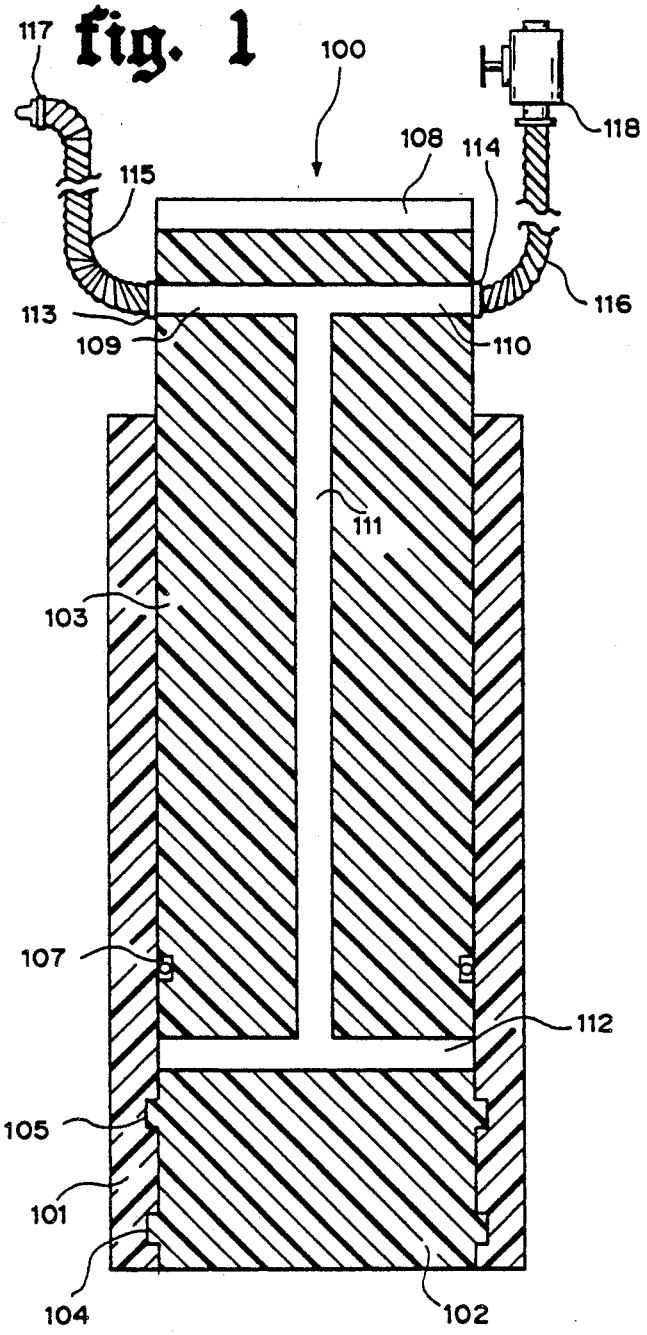
FIG. 1 is a side elevational view in cross section of one embodiment of the foundation leveling shim of the present invention.

In FIG. 1 there is shown a cross sectional view of the preferred embodiment of the self contained foundation leveling shim generally depicted at 100. The shim is comprised of a cylindrical outer housing 101 made of suitable pressure and corrosion resistant material. In one embodiment the housing is of filament wound fiber glass and epoxy. In the lower end of the housing 101 is a base 102. For ease of manufacture, the base 102 may be of a hardenable material which is simply poured into the housing 101. Grooves 104 and 105 serve to retain the hardened base 102 within the housing 101. Alternatively, the base may be machined with the housing or threaded into the housing. In either case the base must be in sealing engagement with the inner surface of the housing.

A piston 103 is slidably mounted within the housing 101. A seal is provided between piston 103 and the inner surface of housing 101 as by 0-ring lip seal 108. Such seal may be of the type manufactured by Parker Seals and sold under the trademark POLYPAK. Alternatively a simple 0-ring seal may be used. Between piston 103 and base 102 there is defined a chamber 112 the volume of which changes as the piston 103 moves within the housing 101. An internal diametral passageway comprising opposed radial passageways 109 and 110 extends through piston 103 near the upper end. An axial passageway 111 in piston 103 connects the diametral passageway with chamber 112.

High pressure hoses 115 and 116 are connected to passageways 109 and 110 respectively by connections 113 and 114. Connections 113 and 114 are connected to the openings of the passageways by conventional means, i.e., threads (not shown).

To the end of hose 115 is connected a conventional one way ball check valve grease fitting 117. Hose 115 together with valve 117, fitting 113, passageway 109 and passageway 111 make up the hydraulic fluid inlet means. To the end of hose 116 is connected a high pressure needle valve 118. Hose 116 together with valve 118, fitting 114, passageway 110 and passageway 111 make up the hydraulic fluid outlet means. The hoses 115 and 116 are preferably of plaited stainless steel, but can be of any suitable high pressure material.

A grout cup 108 is provided at the upper end of the piston 103. The grout cup 108 may be filled with hardenable material and is designed with walls which will collapse with pressure. The hardenable material will then deform to fill any uneven surfaces on the under side of the foundation being leveled providing an evenly distributed load across the piston.

Figure 4:
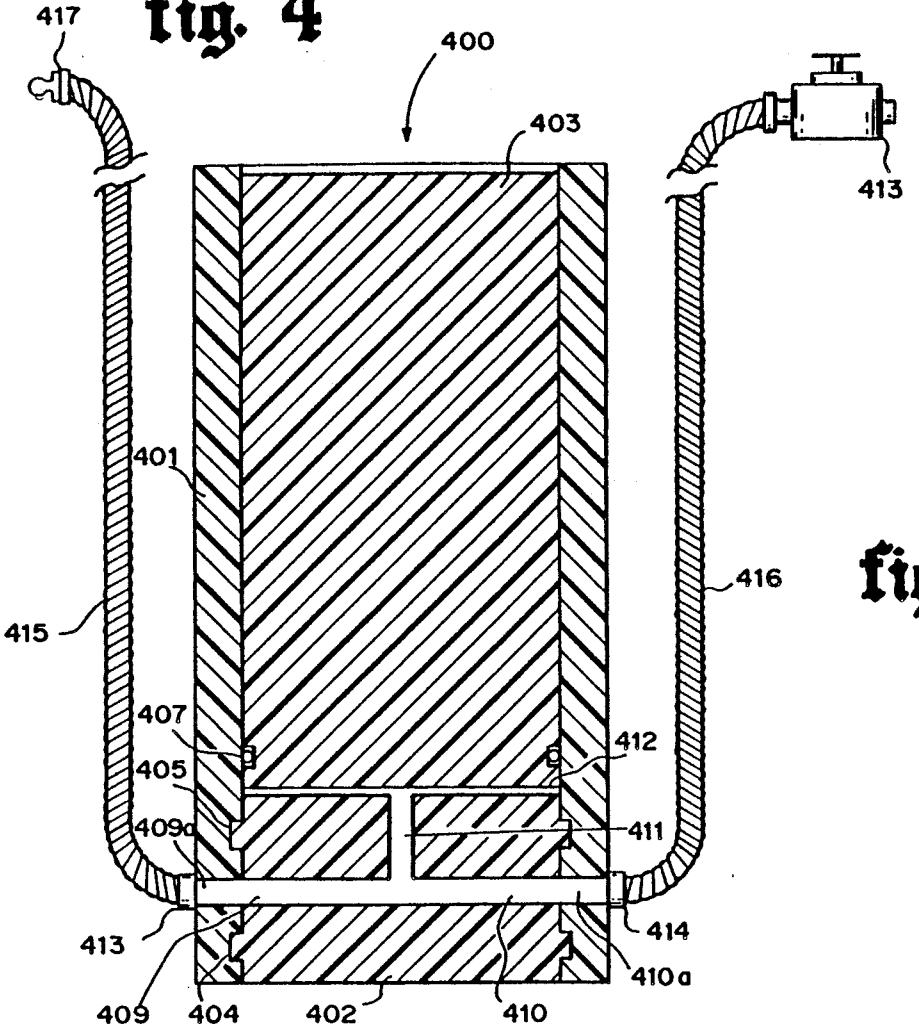
FIG. 4 is a side elevational view in cross section of a second embodiment of the foundation leveling shim of the present invention.

FIG. 4 depicts an alternative embodiment of the self contained foundation leveling shim generally indicated at 400. This embodiment includes housing 401 with base 402 and piston 403 defining chamber 412. The base is retained in place similarly as the first embodiment, i.e., by grooves 404 and 405. Similarly a seal is provided between piston 403 and housing 401 by 0-ring lip seal 408. However, in contrast to the first embodiment, the inlet and outlet means are provided through the housing 401 and base 402. The diametral passageway is provided through housing 401 and base 402 and comprises opposed and aligned radial passageways 409*a* and 410*a* through wall of housing 401 and passageways 409 and 410 through base 402. Axial passageway in base 402 connects the diametral passageway to chamber 412. Hoses 415 and 416 along with valves 417 and 418 are connected to passageways 409 and 410 respectively as in the first embodiment with threaded connections 413 and 414 to complete the hydraulic fluid inlet and outlet means.

In operation a hydraulic fluid source, as a grease gun or high pressure pump, is connected to the inlet hose of either embodiment and hydraulic fluid injected into the chamber. The hydraulic fluid forces the piston upward (or the base downward) to provide a lifting action while the one way ball check valve prevents the fluid from escaping. If the piston must be lowered, the needle valve is opened to release the pressure and remove the fluid from the chamber.

Figure 2:
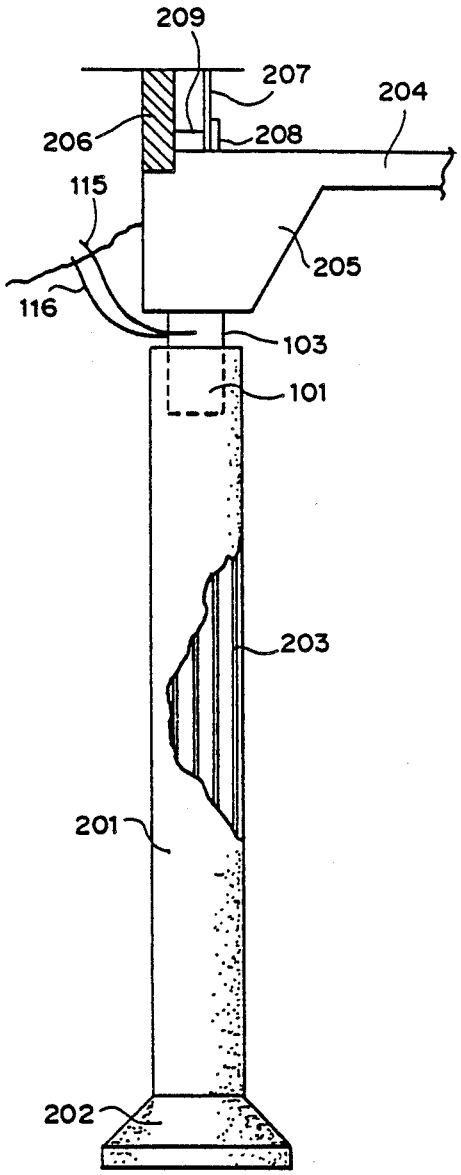
FIG. 2 is a side elevational view of one embodiment of the foundation leveling pier of the present invention.

Referring now to FIG. 2 there is shown one embodiment of the foundation leveling pier of the present invention. This embodiment would be particularly useful in new construction where it could be poured in place before the foundation is laid. The pier is shown to comprise a poured column 201 about reinforcing steel bars 203. The lower end is flared into a bell shaped foot 202 for expanded support in clay soils. The housing 101 of the self contained foundation leveling shim is placed into the uncured concrete at the upper end of the column with the piston 103 exposed. Inlet and outlet hoses 115 and 116 are led to the surface of the foundation. After the concrete pier has hardened the grade beam 205 and foundation 204 may be poured. The pier is directly beneath the grade beam 205 supporting the floor stud 206, wall joist 209, wall board 207 and floor facia 208. Thus corrective action may conveniently be performed at a later date if the foundation settles.

Figure 3:
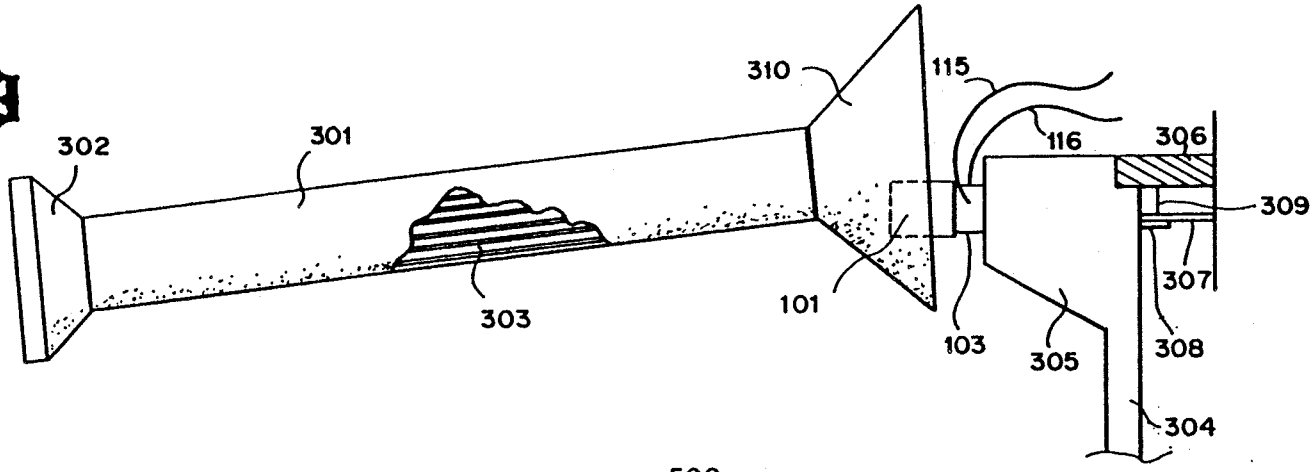
FIG. 3 is a side elevational view of a second embodiment of the foundation leveling pier of the present invention.

Referring now to FIG. 3 an alternate embodiment of the foundation leveling pier is shown. This embodiment is typical of that used to correct existing foundations. The bore for the column 301 is typically off vertical to avoid the existing foundation. The column 301 still surrounds the steel bars 303 and comprises a bell shaped foot 302. However, due to the offset from the foundation grade beam 305 a cap 310 is required at the upper end of the column. The housing 101 of the self contained leveling shim is placed in the uncured concrete of the cap 310 directly below the grade beam 305 with piston 103 exposed. Hoses 115 and 116 are led to the surface with valves exposed. When the concrete has cured, hydraulic fluid may be injected into and removed from the chamber and piston 103 raised and lowered to level the foundation.

Figure 5:
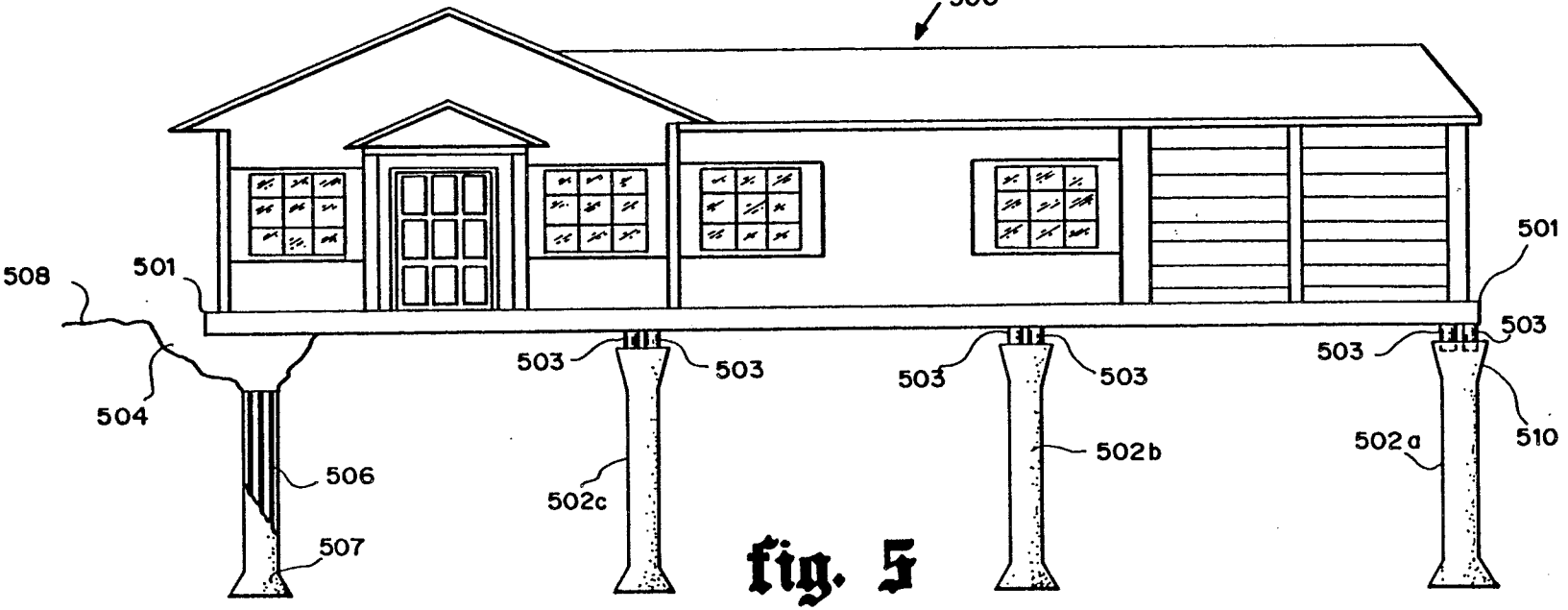
FIG. 5 is a side elevational view in partial cross section of the foundation leveling system of the present invention.
Figure 5:
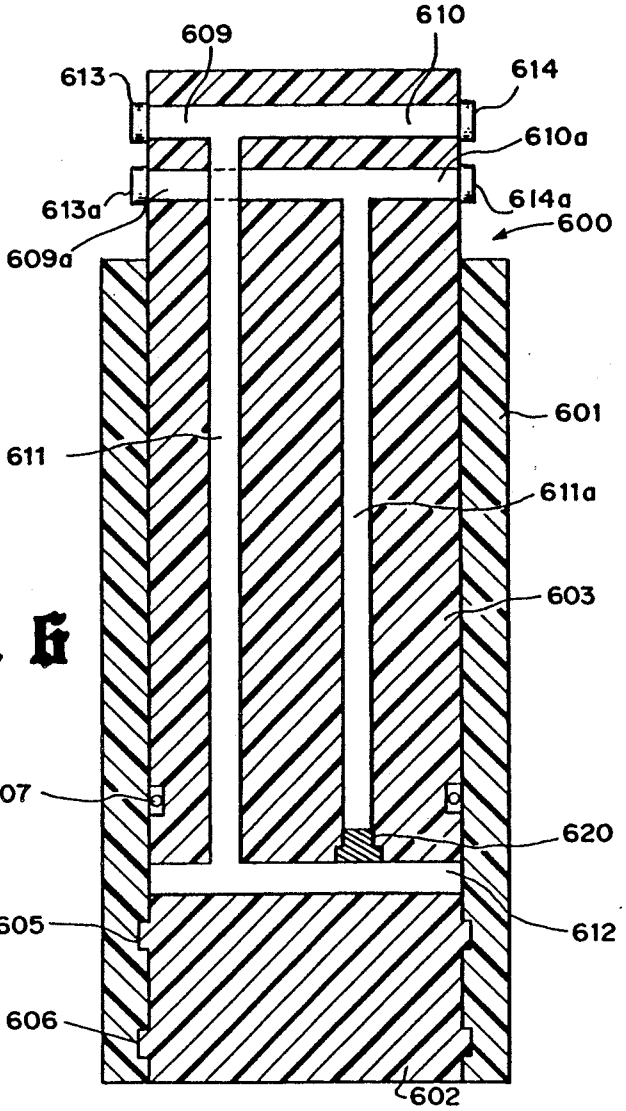

FIG. 5 depicts a system for leveling a foundation. As shown at the left of the figure and excavation 504 is first made in the surface 508 near and under the foundation 501. A shaft 509 is then drilled, usually at a slight angle, underneath the foundation. The shaft is usually flared at the bottom to form a bell 507. Steel rebar 506 is then placed into the shaft and concrete poured about the rebar to fill the shaft. A cap 510 is provided at the upper end of the column 502 which extends under the foundation 501. Before the concrete has cured the self contained leveling shims 503 are placed into the caps 510 between the column and the foundation 501. The hoses (not shown) are then led to the surface and the excavations filled As shown a plurality of the columns with shims is strategically placed about the foundation (often under the middle portion of the foundation also). After all the concrete has cured, hydraulic fluid may be pumped into each shim and/or released as necessary until the foundation is leveled.

The hydraulic fluid may be any standard fluid suitable for the purpose. A grease gun containing inexpensive grease has been found to be sufficient to raise a foundation. In another embodiment a hardenable material may be substituted for the hydraulic fluid which will fill the chamber and harden with time (as the grease will with time). While this procedure may be used with any of the self contained shims, a special shim for this application is shown in FIG. 6. As in the other shims, this one also includes a cylindrical housing 601 with base 602 and piston 603 defining a hydraulic chamber 612. However, two inlets and outlets to the chamber are included as the first used would be filled with the hardened material. A tapered or T shaped plug 620 is inserted in the bottom of one of the passageways 611*a* to be used later to prevent the hardenable material from filling the passageway. When new hydraulic fluid is pumped into the shim, the plug, held by friction, will simply be forced out of the end and allow the new hydraulic to enter the chamber.

The use of the hardenable material as the hydraulic fluid may be preferred because as it sets it protects the dynamic seals from pressure. Over a lengthy period of time with normal fluid, the pressure on the seals may cause them to deteriorate and allow the piston to sink in the housing and thus defeat the leveling function.

Many modifications and variations besides those specifically mentioned herein may be made in the techniques and structures described herein and depicted in the accompanying drawing without departing substantially from the concept of the present invention. Accordingly, it should be clearly understood that the form described and illustrated herein is exemplary only, and is not intended as a limitation on the scope of the present invention.

What is claimed is:

1. A foundation leveling pier for leveling a structure on a solid concrete foundation, comprising in combination:

a concrete pier poured in place beneath the structure to be leveled; and a self contained foundation leveling shim placed within said pier at the upper end between said pier and said structure before said concrete pier is cured, said concrete pier being cured about said leveling shim, said leveling shim being operable to raise said foundation after said concrete pier is cured.

2. A foundation leveling pier for leveling a structure on a solid concrete foundation, comprising in combination:

a concrete pier poured in place beneath the structure to be leveled; and a self contained foundation leveling shim at the upper end of and said pier between said pier and said structure, said leveling shim being placed into said concrete pier before curing with said pier being cured about said leveling shim;

said self contained foundation leveling shim comprising:

an outer cylindrical housing;

a base within the lower end of said housing;

a piston slidably mounted above said base within said housing in sealing engagement with the inner walls of said housing and defining a fluid chamber above said base;

inlet means for injecting a hydraulic fluid between said base and said piston into said chamber; and outlet means for removing said hydraulic fluid.

3. The foundation leveling pier of claim 2 wherein said housing comprises a filament wound fiber glass tube.

4. The foundation leveling pier of claim 3 wherein said base comprises a hardenable material poured into said fiber glass tube and hardened in place within said tube.

5. The foundation leveling pier of claim 2 wherein said inlet means comprises:

a first internal passage way to said chamber;

a first high pressure hose connected to said first passageway and leading to the surface upon which said foundation rests; and a one way check valve connected in line with said first hose to prevent said hydraulic fluid from escaping from between said base and said piston.

6. The foundation leveling pier of claim 5 wherein said outlet means comprises:

a second internal passage way to said chamber;

a second high pressure hose connected to said second passageway and leading to the surface upon which said foundation rests; and a valve connected in line with said second hose at said surface to allow said hydraulic fluid to escape when said valve is opened.

7. The foundation leveling pier of claim 6 wherein said first and second internal passageways are within said piston.

8. A foundation leveling pier for leveling a structure on a solid concrete foundation, comprising in combination:

a concrete pier poured in place beneath the structure to be leveled; and a self contained foundation leveling shim at the upper end of said pier between said pier and said structure;

said self contained foundation leveling shim comprising:

an outer cylindrical housing of filament wound fiber glass tubing;

a base within the lower end of said housing;

a piston slidably mounted above said base within said housing in sealing engagement with the inner walls of said housing and defining a fluid chamber above said base;

inlet means for injecting a hydraulic fluid between said base and said piston into said chamber; and outlet means for removing said hydraulic fluid.

9. The foundation leveling pier of claim 8 wherein said base comprises a hardenable material poured into said fiber glass tube and hardened in place within said tube.

10. The foundation leveling pier of claim 8 wherein said inlet means comprises:

a first internal passage way to said chamber;

a first high pressure hose connected to said first passageway and leading to the surface upon which said foundation rests; and a one way check valve connected in line with said first hose to prevent said hydraulic fluid from escaping from between said base and said piston.

11. The foundation leveling pier of claim 10 wherein said outlet means comprises:

a second internal passage way to said chamber;

a second high pressure hose connected to said second passageway and leading to the surface upon which said foundation rests; and a valve connected in line with said second hose at said surface to allow said hydraulic fluid to escape when said valve is opened.

12. The foundation leveling pier of claim 11 wherein said first and second internal passageways are within said piston.

* * * * *